US007948197B2

(12) United States Patent
Shackelford, IV

(10) Patent No.: US 7,948,197 B2
(45) Date of Patent: May 24, 2011

(54) CONTROLLING TORSIONAL SHAFT OSCILLATION

(75) Inventor: James Luther Shackelford, IV, Owensville, IN (US)

(73) Assignee: Peabody Energy Corporation, St. Louis, MO (US)

( * ) Notice: Subject to any disclaimer, the term of this patent is extended or adjusted under 35 U.S.C. 154(b) by 726 days.

(21) Appl. No.: 12/016,533

(22) Filed: Jan. 18, 2008

(65) Prior Publication Data

US 2008/0203949 A1 Aug. 28, 2008

Related U.S. Application Data

(60) Provisional application No. 60/891,902, filed on Feb. 27, 2007.

(51) Int. Cl.
*H02P 11/00* (2006.01)
*H02P 9/00* (2006.01)

(52) U.S. Cl. ..... 318/611; 318/434; 318/460; 322/19

(58) Field of Classification Search ..... 318/611, 318/623, 630, 432, 434, 460; 322/19, 40, 322/37, 99, 100

See application file for complete search history.

(56) References Cited

U.S. PATENT DOCUMENTS

| | | | | | |
|---|---|---|---|---|---|
| 4,377,780 | A * | 3/1983 | Bjorklund | 322/29 |
| 5,841,254 | A * | 11/1998 | Balch et al. | 318/430 |
| 6,072,297 | A * | 6/2000 | Xu et al. | 318/630 |
| 6,163,121 | A * | 12/2000 | Kumar et al. | 318/434 |
| 6,756,758 | B2 * | 6/2004 | Karikomi et al. | 318/434 |
| 6,903,529 | B2 * | 6/2005 | Kunzel et al. | 318/611 |
| 7,173,399 | B2 * | 2/2007 | Sihler et al. | 322/40 |
| 7,423,411 | B2 * | 9/2008 | Sihler | 322/19 |
| 7,808,215 | B2 * | 10/2010 | Markunas et al. | 322/44 |
| 2008/0041141 | A1 * | 2/2008 | Discenzo | 73/66 |

* cited by examiner

*Primary Examiner* — Eduardo Colon-Santana
(74) *Attorney, Agent, or Firm* — Senniger Powers LLP

(57) ABSTRACT

Torsional oscillation of a shaft in a swing drive system of an excavator is minimized by monitoring torsional strain of the shaft. An electric motor provides torque to the shaft in response to a drive signal provided by a converter. A compensation circuit produces a compensation signal as a function of torsional strain of the shaft. A field excitation circuit or regulator powers a converter as a function of the compensation signal such that a counter torque is provided to the shaft and torsional oscillation of the shaft is reduced.

24 Claims, 6 Drawing Sheets

CONTROLLING TORSIONAL SHAFT OSCILLATION

BACKGROUND OF THE INVENTION

Excavators (i.e., draglines or rope shovels) are used to move relatively large amounts of overburden or ore, typically required in surface mining operations. An excavator includes a bucket, a boom, a revolving frame, and a base. An operator controlling a dragline manipulates the dragline to fill the bucket. The bucket is lifted such that it is suspended from the boom. The operator then causes the revolving frame of the dragline to turn or swing relative to the base, and dumps the contents of the bucket.

A swing drive system of the dragline is responsive to input from the operator for turning the revolving frame of the dragline relative to the base. The swing drive system includes a number of generators, electric motors, gear sets, and shafts. The generators power the motors from a main power supply, and a shaft transfers torque from each motor to an associated gear set. The shafts experience torsional stresses and may experience torsional oscillations which can cause premature failure of the shaft, the driven gear set, and any couplings (e.g., intermediate gear boxes) or bearings associated with this mechanical system of the swing drive system. Oscillations in the swing drive system also impact the boom (i.e., cause additional stress in the boom, particularly at the base of the boom).

Prior art swing drive systems used in excavators (i.e., draglines) such as the Bucyrus 1570 dragline include one or more sets of two generators and two motors. Two sets are shown in prior art FIGS. 1 and 2. The armatures of the two generators and two motors in each set (GEN1 and GEN2 are one set and GEN3 and GEN4 are the other set) are connected in series with one another. The fields of the two motors in each set are excited with a constant voltage source. Referring to FIG. 1, the fields of the generators in each set are excited by a common, variable direct current (DC) source so as to control the power supplied to the associated motors. This configuration of motors and generators is intended to accomplish load sharing and speed matching between the motors in each set and between the two sets to reduce torsional oscillation in the mechanical system driven by the motors.

Generators, for example, on a Bucyrus 1570 dragline are Frame MCF-866B, rated 836 kW, 1200 rpm, 475 volts and are equipped with shunt fields wound in accordance with data sheet 255H805XA, sheet 12. There are four generator field circuits, north and south forward circuits and north and south reverse circuits, each circuit having three poles. Each field pole is of 272 turns, has a resistance at 25 degrees C. of 0.295 ohms, and an inductance of 0.87 henries. In one prior art implementation, the generator field circuits are reconfigured such that only the 2 forward circuit of each generator are used as shown in FIG. 1.

The swing drive system motors, for example, on the Bucyrus 1570 dragline are MDV-822-AER, rated 1045 hp, 740 rpm, 475 volts, 1760 amperes and are equipped with shunt fields of 450 turns per pole. The rated field current delivers rated torque and speed. There are two motor field circuits in each motor drawing a total of 26.4 amperes when connected in parallel. The field circuits may be connected in series to draw 13.2 amperes at double the field voltage.

Referring to prior art FIG. 2, a prior art configuration of a swing drive system of a Bucyrus 1570 dragline is shown. Kirchoff's Law states that the sum of the voltages around an electrical circuit must equal zero. Thus, ideally a first generator armature 102 would produce positive 400 volts and an associated first motor armature 104 would produce a counter-emf of negative 400 volts. A second generator armature 106 and an associated second motor armature 108 would do likewise such that the sum of voltages around the armature loop 110 would be zero. However, in the four-machine armature loop of FIG. 2, the two motor armatures do not always produce the same counter-emf because of variations in their operation due to varying electrical impedances and changing load torques (i.e., gear engagement or cogging of the gears driven by the motor) and load speeds. For example, one motor can generate 420 volts while the other generates 380 volts and still satisfy Kirchoff's Law. Thus, speed and counter-emf can change at random and yet maintain a summation of around-the-circuit voltage at zero. Therefore, in the prior art shown in FIG. 2, a balance resistor 112 was added in the armature loop of each generator motor set in parallel with a motor of one pair and a generator of another pair to further balance the voltages between the motor and generator pairs in order to reduce mechanical stresses applied to the shafts and gear sets of the swing drive system.

In operation, the operator of the excavator selects an acceleration of the swing drive system via a master switch (not shown) by manipulating a controller, such as a masterswitch, control stick, a lever, or some other input device. In response, the regulator 114 applies power to the generator field circuits of each generator via a generator field exciter 116. One prior art method of controlling the swing drive system on the excavator assumes that the current in one armature loop 110 is the same as the current in every other armature loop and assumes that the voltage of all of the generator armatures are the same. The regulator 114 regulates the current (i.e., torque) applied to all of the generator fields as a function of the acceleration selected by the operator (i.e., operator input) and the voltage and current of a single generator armature such that the voltage limit (i.e., speed limit) of the motors is not exceeded.

Other prior art swing drive systems include multiple sets of direct current (DC) static motor armature power supplies associated and an equal number of DC motors. Other swing drive systems are powered by sets of alternating current (AC) variable frequency drives and an equal number of AC motors in which the frequency and voltage of the power from the AC variable frequency drives controls the torque output of the AC motors.

SUMMARY

In one embodiment of the invention, motors and generators of a swing drive system are configured in a one generator to one motor configuration. A pair of forward field circuits of each generator are connected in series with one another, and a pair of reverse field circuits of each generator are connected in series with one another. The pair of series connected forward field circuits and the pair of series connected reverse field circuits are connected in parallel with one other to create the field circuit for each generator. Regulators of the swing drive system provide current to the generator field circuits as a function of operator input.

In one embodiment, a torsion sensor or strain gauge is applied to a shaft of a mechanical system of the swing drive system to provide a torsional strain signal. The shaft provides force to a load (e.g., a gear) from a motor driven by a generator (i.e., a converter such as a DC generator, an AC generator, or a static DC power converter). A regulator provides power to a field of the generator as a function of the torsional strain signal in order to control the force applied to the shaft by the motor. The regulator varies the current or power it provides to the generator field in order to provide a counter torque to the shaft and reduce torsional oscillation of the shaft. Optionally, the torsional strain signal may be filtered about a natural frequency or resonance frequency of the mechanical system.

In one form the invention is a method of minimizing torsional oscillation of a shaft, comprising:

generating a drive signal in response to receiving power at a converter;

providing torque from a motor to the shaft in response to the drive signal driving the motor;

sensing a torsional strain of the shaft;

producing a compensation signal as a function of the sensed torsional strain; and providing power to the converter as a function of the compensation signal.

In yet another embodiment, the invention comprises a method of modifying an excavator swing drive system by monitoring a torsional strain of a shaft driven by a drive motor and regulating a separately excited field of a converter connected to the drive motor as a function of the monitored torsional strain such that torsional oscillation of the shaft is attenuated.

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Other features will be in part apparent and in part pointed out hereinafter.

BRIEF DESCRIPTION OF THE DRAWINGS

Corresponding reference characters indicate corresponding parts throughout the drawings.

DESCRIPTION

Figure 1:
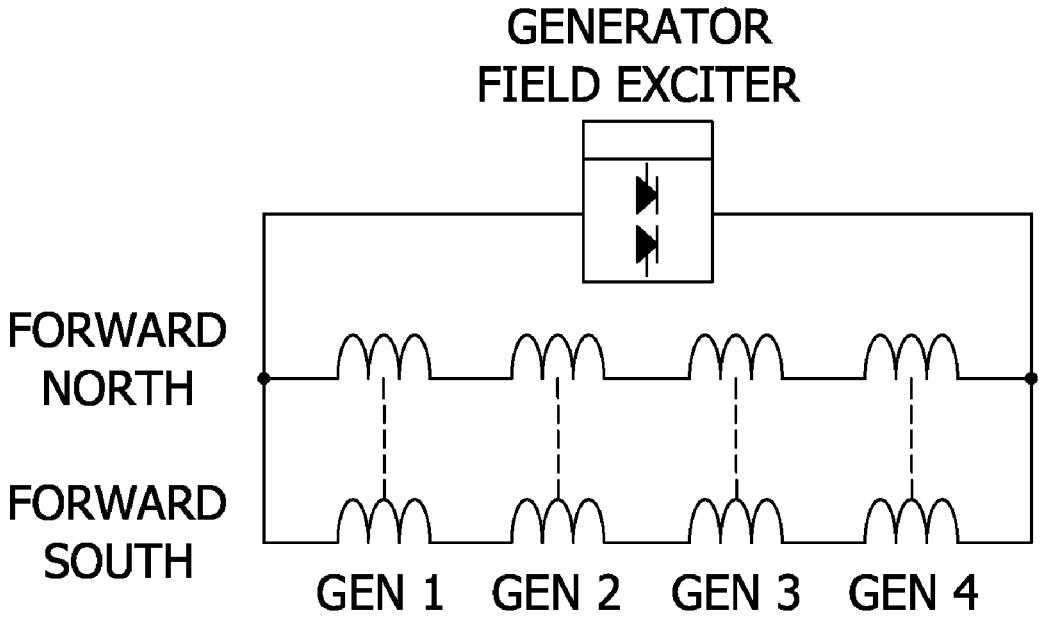
FIG. 1 PRIOR ART
FIG. 1 is a PRIOR ART schematic diagram of a generator field circuit configuration.
Figure 2:
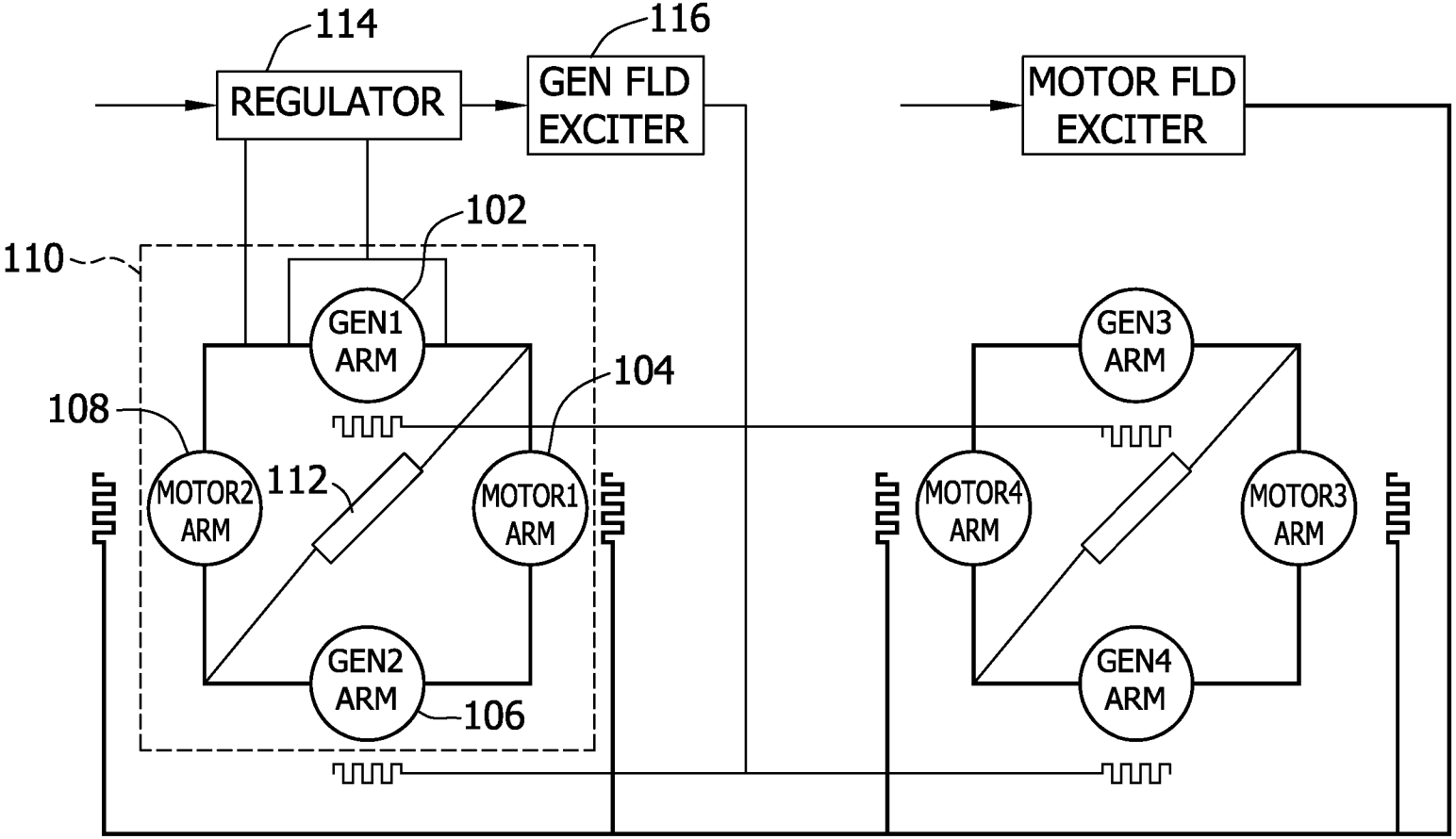
FIG. 2 PRIOR ART
FIG. 2 is a PRIOR ART block diagram of a swing drive system.
Figure 3:
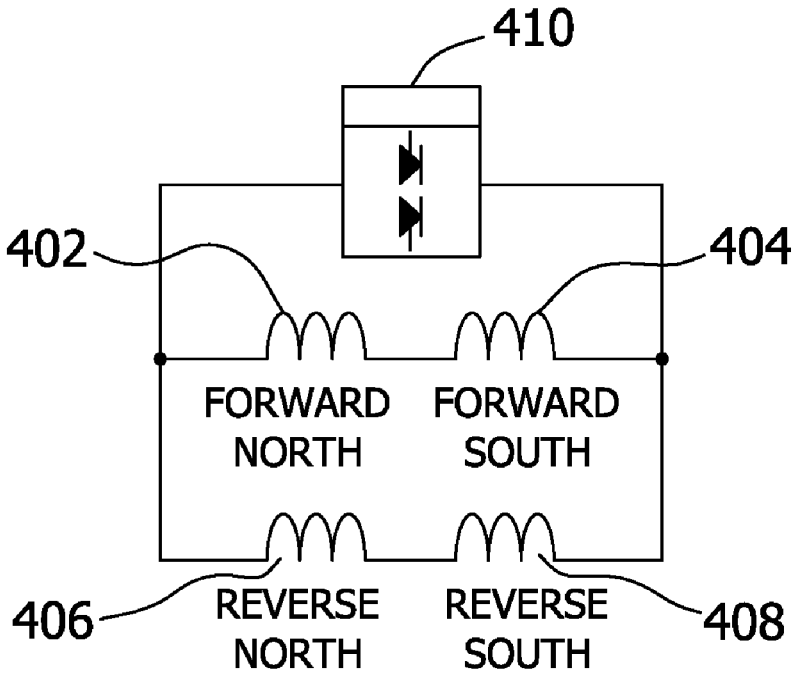
FIG. 3 is schematic diagram of a generator field circuit configuration according to one embodiment of the invention.

Referring to FIG. 3, a schematic diagram of a generator field circuit configuration according to one embodiment of the invention is illustrated, including a four field generator having a forward north field 402, a forward south field 404, a reverse north field 406, and a reverse south field 408. The forward north field 402 is connected in series with the forward south field 404, and the reverse north field 406 is connected in series with the reverse south field 408 to improve flux balance around the frame of the generator. The series connected forward fields 402, 404 are connected in parallel with the series connected reverse fields 406 in order to double the field gain of the generator and increase power efficiency of the generator. In one embodiment, the field circuits of four generators of a swing drive system (e.g., the swing drive system of a Bucyrus 1570 dragline) are configured in this manner with each generator having an associated generator field exciter 410.

Figure 4:
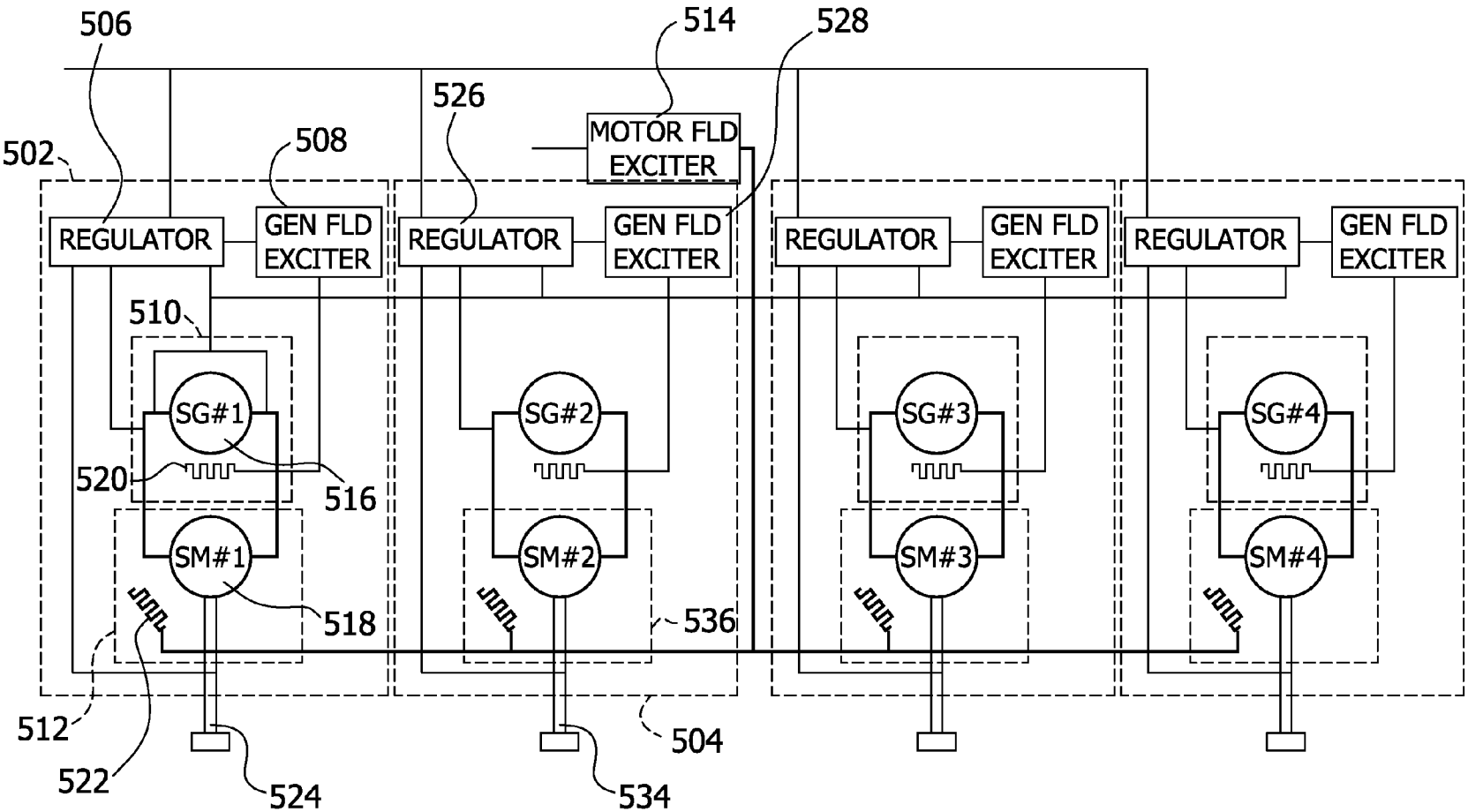
FIG. 4 is a block diagram of a swing drive system according to one embodiment of the invention.

Referring to FIG. 4, a block diagram of a swing drive system according to one embodiment of the invention is illustrated. The swing drive system comprises four generator motor circuits, each having an associated generator field exciter according to one embodiment of the invention. The swing drive system includes one master generator motor circuit 502, and at least one slave generator motor circuit 504. In the embodiment shown in FIG. 4, the swing drive system includes three slave generator motor circuits. It is contemplated that a swing drive system may include only a master generator motor circuit 502 and no slave generator motor circuits 504. It is also contemplated that the motors may be driven by a static direct current (DC) armature supply such as a DC to DC power converter, or an alternating current (AC) to DC converter instead of by the associated generators shown in FIG. 4. It is also contemplated that the motors may be AC motors driven by AC sources such as AC generators or power inverters, wherein the power provided to the motors is controlled by controlling an output frequency and voltage of the AC generators.

The master generator motor circuit 502 includes a regulator 506, a generator field exciter 508, a generator 510, and a motor 512. A generator armature 516 of the generator 510 and a motor armature 518 of the motor 512 are electrically connected to form an armature loop such that the voltage and the current of the motor armature 518 are equal to the voltage and the current of the generator armature 516. The regulator 506 provides a control signal to the generator field exciter 508 as a function of operator input, system power rules, a voltage of the generator armature 516 and the motor armature 518, a current of the generator armature 516 and the motor armature 518, and a strain signal from a strain gauge measuring the strain on a shaft 524 driven by the motor 512. In one embodiment, the control signal is a variable direct current (DC) signal. In another embodiment, the control signal is a digital signal indicative of a desired power level.

The generator field exciter 508 provides a variable direct current (DC) to the generator field 520 as a function of the control signal. In one embodiment, the generator field exciter 508 provides up to 40 amperes at 280 volts DC to the generator field 520. It is contemplated that in another embodiment, the generator field exciter 508 provides a regulated DC voltage to the generator field 520.

While the swing drive system is in operation, a motor field exciter 514 supplies either a fixed low speed motor field voltage or a fixed high speed motor field voltage to a motor field 522 of the motor 512. A voltage of the motor armature 518 is indicative of a rotational speed of the motor 512, and the motor field exciter 514 switches between the low speed motor field voltage and the high speed motor field voltage as a function of the voltage of the motor armature 518. In one embodiment, the low speed motor field voltage is 90 volts direct current (DC), and the high speed motor field voltage is 120 volts DC. In one embodiment, the motor field exciter 514 supplies the same voltage to all of the motor fields in all of the master and slave generator motor circuits of the swings drive system. It is contemplated that in another embodiment, the motor field exciter 514 may supply a fixed DC voltage to the motor field regardless of the voltage of the motor armature.

The regulator 506, generator field exciter 508, and motor field exciter 514 all receive power from a main power supply. In one embodiment, the main power supply provides 240 volts 3 phase alternating current (AC) to the swing drive system. It is contemplated that the main power supply may also provide power at 240 volts 3 phase AC, or at 480 volts 3 phase AC or single phase AC. It is also contemplated that the main power supply may be a DC power source.

The slave generator motor circuit 504 is configured substantially the same as the master generator circuit 502. However, the regulator 526 (i.e., slave regulator) of the slave generator motor circuit 504 uses different inputs and provides a control signal to the generator field exciter 528 (i.e., slave generator field exciter) of the slave generator motor circuit 504 independent of the control signal of the regulator 506 of the master generator motor circuit 502. The slave regulator 526 provides its control signal to the slave generator field exciter 528 as a function of operator input, system power rules, the voltage of the motor armature 518 of the master generator motor circuit 502, a current of a slave motor armature 532 of the slave generator motor circuit 504, and a strain signal from a strain gauge measuring the strain on a shaft 534 driven by a slave motor 536 of the slave generator motor circuit 504.

In one embodiment, the swing drive system includes a safety system. The safety system monitors the voltage of each motor armature of all of the master and slave generator motor circuits and shuts down the entire drive system if the voltage of any motor armature exceeds a predetermined level (e.g., 660 volts DC). It is contemplated that the safety system may also monitor the current of each of the motor armatures and shut down the swing drive system if any individual current or the total current exceeds predetermined thresholds.

In addition to the electrical limitations of motors, converters (i.e., static power converters and generators) in a swing drive system, an excavator (e.g. dragline or swing shovel) including the swing drive system may have physical limitations. That is, the length of a boom of the excavator, and the size of a bucket of the excavator (i.e., the amount of material and weight supported by the boom) may limit the safe acceleration of the swing drive system. That is, the swing drive system may be capable of more acceleration than the boom is capable of supporting. Therefore, the regulators of the swing drive system must limit the output of the swing drive system as a function of the force exerted on the boom, and maximum operating parameters (i.e., an operating envelope) must be determined for implementation in the system rules of the swing drive system. For example, in one embodiment of a swing drive system having four swing motors under maximum shunt field, maximum torque occurs near the stall value of armature current. However, not all of the torque produced by the motors appears at the boom because of gear efficiency (i.e., inefficiency). In a swing drive system having three gear reductions and assuming that modern, machine-cut gears having 97% efficiency are employed, the overall efficiency is 0.97 cubed or about 91%. Thus, 0.91 per unit torque arrives at the base of the boom when accelerating a loaded bucket.

Conversely, because of the efficiency (or inefficiency) of the gears, the expected torque at the base of the boom would be greater than desired because of the reversal of efficiency during deceleration of the bucket. Losses in the gears significantly increase the apparent torque at the base of the boom. Therefore, system rules or limits in deceleration are reduced to limit the torque at the base of the boom to that of the torque when accelerating a load (i.e., a full bucket). For the above example of a swing drive system having 3 gear sets, the overall efficiency is 0.91 squared or 0.83 per unit. That is, the torque in the motors should be limited to 83% of the maximum torque allowed (i.e., desired) at the base of the boom.

Figure 5:
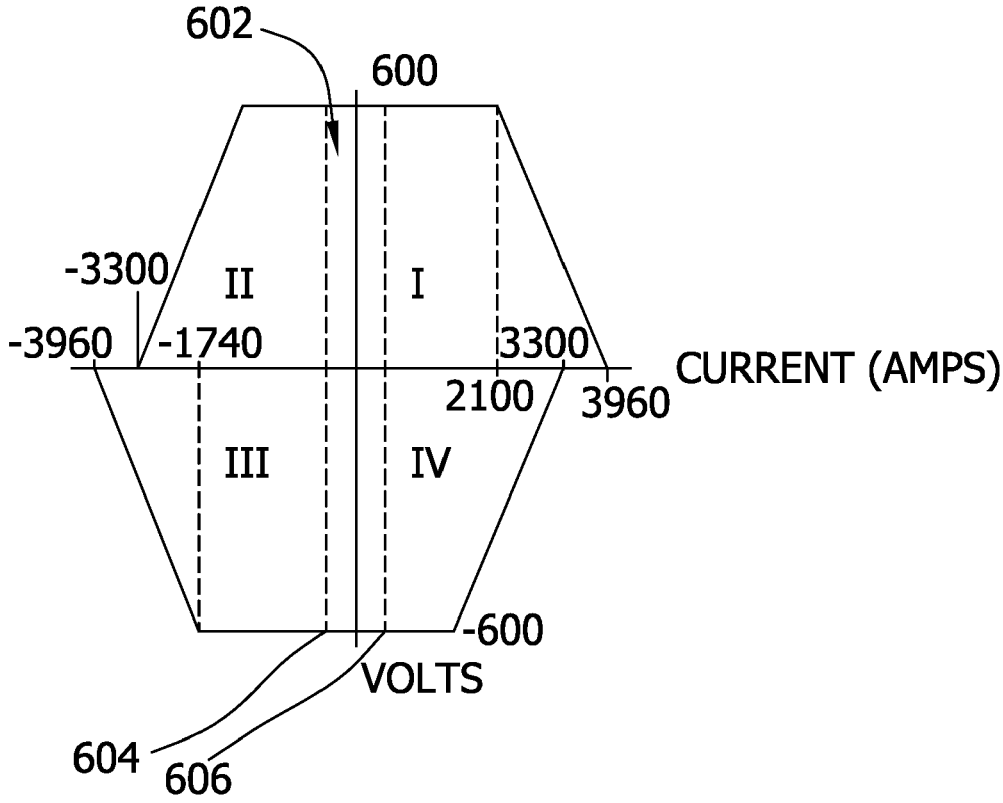
FIG. 5 is an exemplary operating envelope according to one embodiment of the invention.

The combination of the physical limitations of the excavator and the electrical limitations of the swing drive system yields an operating envelope (i.e., operational parameters or system rules) for a given excavator. Referring to FIG. 5, an example of an operating envelope for a Bucyrus 1570 dragline is shown. The swing drive system of the Bucyrus 1570 dragline includes 3 gear reductions. In quadrant I, both voltage and current in the motor are positive, and the dragline is accelerating the boom in the counterclockwise (i.e., forward) direction. The swing drive system limits the total motor armature stall current to 3960 amperes, and each motor armature is limited to 600 volts. The swing drive system provides maximum power at 600 volts and 2100 amperes in the motor armatures. In quadrant II, the motor armature voltage is still positive, but the swing drive system is decelerating such that the motors are producing current (i.e., current is negative) to be regenerated into the main power supply. In quadrant II, the stall current of the motor armatures is limited to 3300 amperes (and the armature voltage is still limited to 600 volts). In quadrant III, the motor armature voltage and current are negative, and the swing drive system is accelerating the load (i.e., bucket) in the clockwise (i.e., reverse) direction. The swing drive system develops maximum power at 600 volts and 1740 amperes in the motor armatures, and the stall current is limited to 3960 amperes. In quadrant IV, the swing drive system is decelerating the bucket such that the voltage and the current of the motor armatures are negative. The stall current in quadrant IV is limited to 3300 amperes (and the armature voltage is limited to 600 volts). These voltage and current values are to be considered for illustrative purposes only and vary based upon the mechanical and electrical limitations of each excavator.

When the swing drive system is not moving, the high gear reduction of the system allows the gears to be in a backlash region 602 (i.e., the gear faces in a gear set are not fully engaged with one another). If the swing drive system quickly accelerates through the backlash region 602, then the gear faces may collide with enough force to damage them or at least cause excessive, unnecessary wear. Referring to FIG. 5, lines 604 and 606 bound the backlash region 602, and within this region, the swing drive system limits the voltages (i.e., speed) of the motor armatures until a predetermined current is present in the motor armatures.

Figure 6:
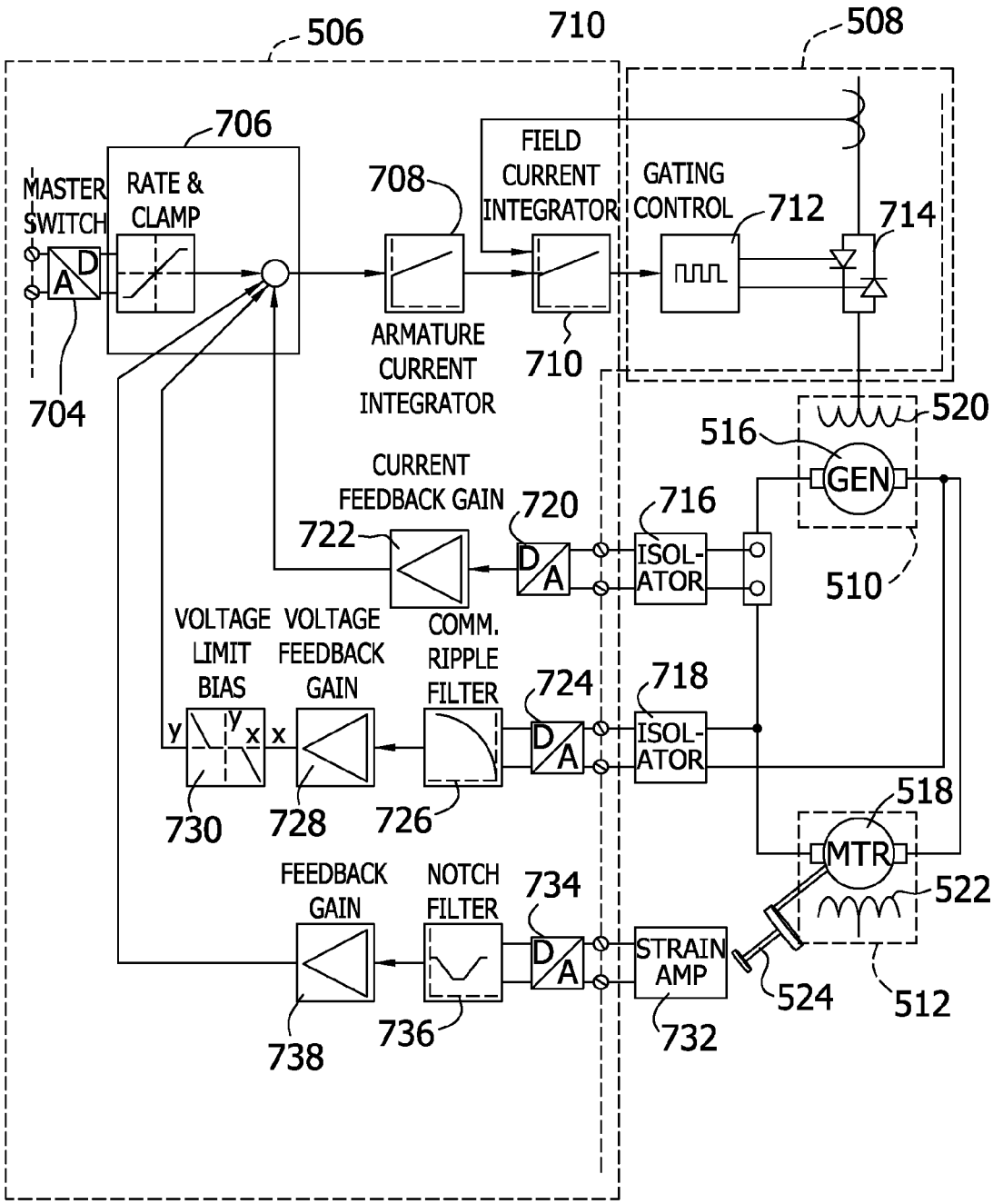
FIG. 6 is a block diagram of a master regulator according to one embodiment of the invention.

Referring to FIG. 6, portions of the master generator motor circuit 502 of FIG. 4 are shown in greater detail. A master switch 704 provides a command from an operator indicative of a direction and acceleration (or deceleration) of the swing drive system to a controller 706 of the regulator 506. The controller 706 enforces the operating envelope described above with respect to FIG. 5 and determines a desired acceleration as a function of exponential clamp functions. For example, if the current in the motor armature is not above a predetermined level, then the controller 706 provides a reference acceleration rate for up to 6 seconds (or until there is current present in the motor armature). If the swing drive system is in the backlash region 602, then the controller 706 multiplies the operator input by the exponential function ae^(−6 t) where a is a predetermined scalar and t is time in seconds to determine the desired acceleration. If the swing drive system is not in the backlash region, then the controller 706 multiplies the operator input by the exponential function ae^(−0.6 t) where a is the predetermined scalar and t is the time in seconds to determine the desired acceleration.

The controller 706 provides a signal indicative of the desired acceleration to an armature current integrator 708. The armature current integrator 708 ensures that any discontinuities in the rules and algorithms implemented by the controller 706 are smoothed such that the regulator 506 (and therefore the swing drive system) has a predictable system response for any given set of inputs to the controller 706. The armature current integrator 708 provides the output signal from the regulator 506 to the associated generator field exciter 508 of the master generator motor circuit 502.

A field current integrator 710 in the generator field exciter 508 receives the output signal from the regulator 506 and monitors the current provided to the generator field circuit 520 by the generator field exciter 508. In normal operation, the field current integrator 710 passes the output signal from the regulator 506 to a gating control 712. However, if the field current integrator 710 determines that the current in the generator field circuit 520 exceeds a predetermined limit, then the field current integrator 710 shuts down the gating control 712 such that no power is provided to the generator field circuit 520. In one embodiment, the field current integrator 710 also informs the safety system of the swing drive system of the overcurrent condition, and the safety system shuts down all of the generator motor circuits of the swing drive system.

The gating control 712 provides gating signals to a silicon controlled rectifier (SCR) matrix 714. The SCR matrix 714 receives power from the main power supply and provides pulse width modulated power of the polarity indicated by the gating signals to the generator field circuit 520. In one embodiment, the SCR matrix 714 is a 3 phase full reversing bridge comprising 12 SCR's. In response to receiving the power in the generator field circuit 520, the generator armature 516 turns and provides a generally DC voltage and current to the associated motor armature 518. An armature current sensor 716 provides a signal indicative of the armature current to the regulator 506, and an armature voltage sensor 718 provides a signal indicative of the armature voltage to the regulator 506.

The regulator 506 receives the signal indicative of the armature current from the armature current sensor 716 at an analog to digital converter 720 of the regulator 506. The analog to digital converter 720 provides a digital representation of the signal indicative of the armature current to a current feedback amplifier 722. The current feedback amplifier 722 amplifies the digital representation and provides the amplified digital representation to the controller 706. The controller 706 uses the amplified digital representation of the armature current to enforce the operating envelope of the swing drive system when determining the desired acceleration of the swing drive system.

The regulator 506 receives the signal indicative of the armature voltage from the voltage sensor 718 at a second analog to digital converter 724. The second analog to digital converter 724 provides a digital representation of the signal indicative of the armature voltage to a commutator ripple filter 726. The commutator ripple filter 726 removes relatively high frequency commutator noise from the signal, and a voltage feedback amplifier 728 amplifies the filtered signal. A voltage limit bias circuit 730 passes the amplified signal from the voltage feedback amplifier 728 to the controller 706 only when the voltage of the armature exceeds a predetermined voltage (e.g., 575 volts). The controller 706 receives the signal indicative of armature voltage and uses the received signal to control the speed of the motor 512 via the generator field exciter 508.

The motor armature 518 receives the power from the generator armature 516 and turns the shaft 524. A strain gauge 732 monitors torsional flex (i.e., strain) of the shaft 524 and provides a signal indicative of the torsional strain to the regulator 506. In one embodiment, a third analog to digital converter 734 of the regulator 506 receives the signal and provides a digital representation of the torsional strain to a strain feedback amplifier 738. In one embodiment, a notch filter 736 receives the digital representation from the third analog to digital converter 734 and filters (i.e., applies a band pass filter to) the strain signal about a resonant frequency of the mechanical system driven by the motor 512. The mechanical system may include, for example, the shaft 524 and gears driven by the shaft 524, as well as the revolving frame, boom and bucket of the excavator. For example, the resonant frequency of the mechanical system of the Bucyrus 1570 dragline is 2.26 hertz. The strain feedback amplifier 738 amplifies the received strain signal and provides the amplified signal to the controller 706. The controller 706 determines a proportional counter torque signal to the strain signal and varies its output signal to the armature current integrator 708 accordingly. Thus, the regulator 506 produces a counter torque to any torsional oscillations present in the shaft 524. One skilled in the art will recognize that the faster the response time (i.e., sample rate) of the regulator 506, the better the dampening of the torsional oscillation of the shaft 524.

In one embodiment, the slave generator motor circuit 504 functions the same as the master generator motor circuit 502, with one exception. The voltage signal provided by the voltage limit bias circuit 730 in the regulator 506 of the master generator motor circuit 502 to the controller 706 is also provided to a slave controller of the slave regulator 526 such that the slave regulator 526 uses the armature voltage (i.e., speed) of the motor 512 of the master generator motor circuit 503 as the speed of the slave motor 536. The other inputs to the slave regulator 526 are from the slave generator motor circuit 504 including the current of the slave motor armature 532, the strain of the slave shaft 534, and a current provided by the slave generator field exciter 528. Using the armature voltage of the master motor armature 518 as the armature voltage (i.e., speed) of the slave motor armature 532 increases system stability. In one embodiment, the armature voltage of all of the master and slave generator motor circuits is measured, and if any voltage exceeds a predetermined maximum, the safety system shuts down the swing drive system. Each generator motor circuit uses a strain signal from its own associated output shaft to minimize torsional oscillations of its associated output shaft because the gear engagement of gears driven by each shaft may be different at any given time such that strain and torsional oscillation varies between the shafts.

In one embodiment, the shaft strain sensor or torsional oscillation sensor is the TorqueTrak Revolution Series available from Binsfeld Engineering of Maple City, Mich. which can monitor torque and/or horsepower of a rotationally driven shaft. The system features inductive power and inductive data transfer. Four available output signals are torque, horsepower, revolutions per minute, and shaft direction. This sensor provides continuous power to a transmitter and strain gauge located on the rotating shaft and it delivers continuous data output using inductive, non-contact technology. There are no wear surfaces, so the power and data transmission resist degradation over time. The system includes 14-bit signal processing and mounts external to the shaft such that shaft modification and machine disassembly are not required. Additionally, calibration of the sensor can be done off-the-shaft. One skilled in the art will recognize that any sensor capable of measuring torsional strain or deflection of a shaft may be used with embodiments of the present invention.

It is contemplated that all of the master regulator 506, the slave regulators 526, the generator field exciter 508, the slave generator field exciters 528, and the safety system may be incorporated into a single microchip. Alternatively, portions of these components may be implemented in software of a single computing device or multiple computing devices.

The order of execution or performance of the operations in embodiments of the invention illustrated and described herein is not essential, unless otherwise specified. That is, the operations may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

Embodiments of the invention may be implemented with computer-executable instructions. The computer-executable instructions may be organized into one or more computer-executable components or modules. Aspects of the invention may be implemented with any number and organization of such components or modules. For example, aspects of the invention are not limited to the specific computer-executable instructions or the specific components or modules illustrated in the figures and described herein. Other embodiments of the invention may include different computer-executable instructions or components having more or less functionality than illustrated and described herein.

When introducing elements of aspects of the invention or the embodiments thereof, the articles "a," "an," "the," and "said" are intended to mean that there are one or more of the elements. The terms "comprising," "including," and "having" are intended to be inclusive and mean that there may be additional elements other than the listed elements.

Having described aspects of the invention in detail, it will be apparent that modifications and variations are possible without departing from the scope of aspects of the invention as defined in the appended claims. As various changes could be made in the above constructions, products, and methods without departing from the scope of aspects of the invention, it is intended that all matter contained in the above description and shown in the accompanying drawings shall be interpreted as illustrative and not in a limiting sense.

What is claimed is:

1. A system for minimizing torsional oscillation of a shaft, said system comprising:

a converter for providing a drive signal in response to receiving power wherein the converter has a separately excited field and the drive signal is a function of the excitation of the separately excited field;

a motor for providing torque to the shaft in response to the drive signal provided by the converter;

a sensor for sensing a torsional strain of the shaft;

a regulator for producing a compensation signal as a function of the torsional strain of the shaft; and an excitation circuit responsive to the sensor for regulating the separately excited field to vary the drive signal as a function of the compensation signal such that torsional strain of the shaft is attenuated.

2. The system of claim 1 wherein the converter is a generator having a forward field winding and a reverse field winding to form the separately excited field, and the excitation circuit is a field excitation circuit wherein the field excitation circuit provides power to the separately excited field of the generator.

3. The system of claim 2 wherein the forward and reverse windings sets are wired in parallel such that a gain of the field excitation circuit is increased.

4. The system of claim 1 further comprising a filter wherein the sensor provides a strain signal as a function of the torsional strain of the shaft and the filter filters the strain signal about a base frequency to provide a filtered strain signal; and wherein the compensation signal comprises an inversion of the filtered strain signal.

5. The system of claim 4 wherein the base frequency is a natural frequency of torsional oscillation of the shaft.

6. The system of claim 1 wherein at least one of the following: (1) the shaft provides the received torque to a gear associated with the shaft and (2) the shaft is operatively connected to the motor via a gear set.

7. The system of claim 1 wherein the converter is an alternating current (AC) to direct current (DC) power converter having a shunt wound armature and the drive signal is a DC power signal.

8. The system of claim 1 wherein the converter is an alternating current (AC) power supply and the motor is an AC motor, and the drive signal is a voltage and frequency controlled AC power signal.

9. The system of claim 1 wherein the regulator limits the speed of the motor as a function of a voltage of the motor, wherein the system further comprises a second converter providing power to a second motor, and wherein the second converter limits the speed of the second motor as a function of the voltage of the motor.

10. The system of claim 1 wherein the regulator limits the speed of the motor as a function of a frequency and a voltage of the motor, and wherein the converter is a variable frequency alternating current drive.

11. A method of minimizing torsional oscillation of a shaft, said method comprising:

generating a drive signal in a converter in response to receiving power at the converter wherein the converter has a separately excited field and the drive signal is a function of the excitation of the separately excited field;

providing torque from a motor to the shaft in response to the drive signal driving the motor;

sensing a torsional strain of the shaft;

producing a compensation signal as a function of the sensed torsional strain; and providing power to the separately excited field of the converter as a function of the compensation signal to vary the drive signal as a function of the compensation signal such that the torsional strain of the shaft is attenuated.

12. The method of claim 11 wherein the converter is a generator having a forward field winding and a reverse field winding to form the separately excited field, and providing power to the converter comprises providing power to the separately excited field of the generator.

13. The method of claim 12 wherein the forward and reverse windings sets are wired in parallel such that a gain of the excitation circuit is increased.

14. The method of claim 12 further comprising monitoring an applied torque of the motor and wherein said powering the field is a function of the compensation signal and the applied torque.

15. The method of claim 11 further comprising:

providing a strain signal as a function of the torsional strain; and filtering the strain signal about a base frequency to provide a filtered strain signal; and wherein the compensation signal comprises an inversion of the filtered strain signal.

16. The method of claim 15 wherein the base frequency is a natural frequency of torsional oscillation of the shaft.

17. The method of claim 11 wherein the shaft provides the received torque to a gear attached to the shaft and the shaft is operatively connected to the motor via a gear set.

18. The method of claim 11 wherein the converter is an alternating current (AC) to direct current (DC) power converter having a shunt wound armature and the drive signal is a DC power signal.

19. The method of claim 11 wherein the converter is an alternating current (AC) power supply and the motor is an AC motor, and the drive signal is a voltage and frequency controlled AC power signal.

20. A method of modifying an excavator swing drive system comprising:

connecting an armature of a converter of the swing drive system to exactly one drive motor;

connecting a forward field winding and a reverse field winding of the converter in parallel to form a single separately excited field;

monitoring a torsional strain of a shaft driven by the exactly one drive motor; and regulating the separately excited field of the converter as a function of the monitored torsional strain such that torsional oscillation of the shaft is attenuated.

21. The method of claim 20 further comprising monitoring a current of the motor, monitoring a voltage of the motor and regulating the separately excited field as a function of the monitored current and the monitored voltage, wherein the monitored current is indicative of a torque of the motor, and the monitored voltage is indicative of a speed of the motor.

22. The method of claim 20 further comprising:

filtering the monitored torsional strain at a predetermined frequency; and regulating the separately excited field of the converter as a function of the filtered torsional strain of the shaft.

23. The method of claim 22 wherein the predetermined frequency is a natural frequency of torsional oscillation of the shaft.

24. The method of claim 20 further comprising monitoring an applied torque of the motor and wherein said regulating the separately excited field of the converter is a function of the monitored applied torque.

* * * * *